US005446969A

United States Patent [19]

Terenzoni

[11] Patent Number: 5,446,969

[45] Date of Patent: Sep. 5, 1995

[54] COMBINATION SQUARE AND MULTI-PURPOSE HAND TOOL

[76] Inventor: Robert Terenzoni, 98 Boston Ave., Medford, Mass. 02155

[21] Appl. No.: 81,621

[22] Filed: Jun. 23, 1993

[51] Int. Cl.[6] ..... B43L 7/14

[52] U.S. Cl. ..... 33/419; 33/421; 33/451; 33/464; 33/473

[58] Field of Search ..... 33/415, 416, 417, 418, 33/419, 420, 421, 423, 424, 425, 426, 464, 470, 473, 459, 451, 461, 460

[56] References Cited

U.S. PATENT DOCUMENTS

| | | | |
|---|---|---|---|
| 200,628 | 2/1878 | Owen | 33/419 |
| 325,036 | 8/1885 | Woodhull . | |
| 558,117 | 4/1896 | Spaulding | 33/420 |
| 607,907 | 7/1898 | Allen | 33/419 |
| 734,290 | 7/1903 | Witcher . | |
| 738,422 | 9/1903 | Duffy . | |
| 832,285 | 10/1906 | Wilson | 33/420 |
| 895,468 | 8/1908 | Kampe | 33/420 |
| 1,160,920 | 11/1915 | Lucas . | |
| 1,585,563 | 5/1926 | Schiattau . | |
| 1,653,561 | 12/1927 | Gray | 33/419 |
| 2,246,066 | 6/1941 | Rothe | 33/165 |
| 2,504,244 | 4/1950 | Barclay | 33/420 |
| 2,580,263 | 12/1951 | Wooten | 33/419 |
| 2,668,359 | 2/1954 | Litchfield | 33/154 |
| 3,289,301 | 12/1966 | Hanson | 33/93 |
| 3,574,945 | 4/1971 | Main | 33/70 |
| 4,301,600 | 11/1981 | Charnley | 33/464 |
| 4,825,559 | 5/1989 | Santos | 33/630 |
| 5,129,153 | 7/1992 | Burns, Sr. | 33/613 |
| 5,205,045 | 4/1993 | Liu | 33/426 |
| 5,226,238 | 7/1993 | Rahnefeld | 33/419 |

FOREIGN PATENT DOCUMENTS

| | | | |
|---|---|---|---|
| 1185601 | 4/1959 | France | 33/460 |
| 11715 | of 1889 | United Kingdom | 33/419 |

*Primary Examiner*—Thomas B. Will

*Attorney, Agent, or Firm*—Daniel J. Bourque; Anthony G. M. Davis; Michael J. Bujold

[57] ABSTRACT

A combination square and multi-purpose hand tool can be utilized as a large number of hand tools including a square, bevel square, stud and ceiling strapping spacer, clamp, caliper, string tender, and scribe. A first L shaped member includes a blade portion and a handle portion. A second member is pivotably and slidably coupled to the blade portion of the first member. Individual member dimensions such as the overall length of the first member, the maximum extended length of the second member along the first member, and the width of the blade portion of the first member are pre-established at selected lengths and widths, to provide predetermined functions for the present multi-purpose hand tool such as a stud spacer, ceiling strapping spacer and string tender.

17 Claims, 10 Drawing Sheets

COMBINATION SQUARE AND MULTI-PURPOSE HAND TOOL

FIELD OF THE INVENTION

This invention relates to hand tools and more particularly, to a multi-purpose hand tool which can serve as a square as well as multiple other tools, measuring gauges and holding devices.

BACKGROUND OF THE INVENTION

Carpenters and in particular, those carpenters performing building framing generally require many hand tools to accomplish their task. In addition to the obvious requirement of a hammer and saw, a framing carpenter also requires the use of a number of additional hand tools such as a right angle square, and adjustable bevel (angled) square, a level, a saw guide and a means for determining the spacing between framing timbers, to name but a few. Although these hand tools are not necessarily used constantly, they are quite frequently used and must always be readily available to the carpenter.

Traditionally, carpenters have maintained and transported one or more large boxes of single purpose hand tools to their work site, from which they draw the appropriate tool, as necessary. Having to stop to retrieve the appropriate single purpose tool, however, is generally a great inconvenience, and costs a considerable amount of time, money and energy. Although it would be desirable, a carpenter cannot possibly keep one of each of the possible requisite hand tools in his or her work apron or pouch.

Several prior art devices are known which attempt to combine several hand tools into one device. Examples of such tools are disclosed in U.S. Pat. Nos.: 325,036; 734,290; 738,422; 1,160,920; 1,585,563; 2,246,066; 2,668,359; 3,289,301; 3,574,945; 4,301,600 and 4,825,559.

Such prior art devices, however, all share one or more deficiencies. For example, all such devices do not include all of the required hand tools in one tool. Others of these devices cannot be easily carried in a carpenter's work apron or pouch. Additionally, none of the prior art devices are designed to provide one or more tools to assist the carpenter who is working alone. Such tools include a dry line holder and a deadman timber holder. Most importantly, none of the prior art devices include means for quickly and accurately measuring and gauging the standard distance between building framing timber.

Accordingly, what is needed is a single, multi-purpose hand tool which provides a carpenter and particularly, a framing carpenter, with the equivalent of a number of hand tools, each of which is required by the carpenter, in one hand tool device. In addition, such a tool should advantageously be lightweight and compact to be easily stored in a carpenter's work apron or pouch.

SUMMARY OF THE INVENTION

The present invention accordingly features a multi-purpose hand tool which includes a first L shaped member having a predetermined length. The first member includes a handle portion extending from and generally perpendicular to a blade portion.

A second member is slidably and pivotably coupled to the blade portion of the first member. Thus, the second member is allowed to slide along the blade portion while coupled to the blade portion between a first position proximate the handle portion and a second position proximate the end region of the blade portion. Additionally, the second member is adapted for pivoting about a pivoting device which couples the first and second members.

In the preferred embodiment, the predetermined length of the first member corresponds to the spacing between two standard framing timbers, currently approximately 14½ inches, while the predetermined width of the blade portion and the second member correspond to the width of a standard framing timber, currently 1½ inches. A second embodiment also includes a butt portion on an outside edge of the handle portion and the second member. The butt portion is perpendicular to first and second planer surfaces of the handle portion and the second member. Additionally, the butt portions have a width which is greater than a predetermined thickness of the handle portion and the second member. The butt portions may further include one or more fastening holes for facilitating attachment of the present invention to an adjacent device such as a framing timber.

Additionally, the handle portion and the second member may also each include at least one fastening hole, for facilitating attachment of the multi-purpose hand tool of the present invention to at least one fixed adjacent device, for temporarily holding a second unfixed adjacent device against the blade portion, for allowing use of the multi-purpose hand tool of the present invention as a deadman holder.

The inside edge of the handle portion of the first member of the present invention preferably includes at least one angular positioning device, for engaging with the second member for establishing at least one predetermined angular position between the first member and the second member. In the preferred embodiment, the angular positioning device includes one or more cutout regions in the inside edge of the handle portion along with indicia of the angular position provided by the cutout region.

The second member may also include a level as well as one or more cutout regions to allow viewing of the level. The level may thus be used to insure the proper orientation of a timber, as well as to facilitate use of the present invention as a bevel square.

Additionally, one or more regions such as the butt portion of the second member may include a small cutout region for engaging with a string, for allowing the multi-purpose hand tool of the present invention to serve as a string tender.

The second member may also include a curvilinear cutout region through which a pivotably coupling device extends, to allow the second member to move between a first position generally perpendicular to the blade portion of the first member, and a second position generally parallel to the blade portion of the first member. Additionally, the curvilinear shaped cutout region may further include a releasably securable member, for maintaining the second member in a predetermined angular position relative to the first member. The present invention also includes indicia on one or both of the first and second members, for visually determining the angular position between the second member and the first member.

The blade portion of the first member further includes a cutout region extending from proximate the handle portion to proximate an end region of the blade, for allowing the second member to slide along the blade region.

Thus, the multi-purpose hand tool of the present invention may function, at any one time, as one or more of a stud spacer, ceiling strapping spacer, deadman holder, dry line tender, adjustable bevel square, right angle square, scribe, saw guide, clamp, level and caliper.

In order to facilitate use of the second member as a bevel square, the second member may comprise first and second segments held in spaced parallel relationship a predetermined distance, the predetermined distance being slightly greater than a predetermined thickness of the handle portion of the first member, providing a recessed region in the second member facing the handle portion for allowing the recessed portion of the second member to engage with and over the handle portion of the first member. Further, in the embodiment utilizing a butt region at least one segment of the butt portion of the second member includes a recess forming first and second butt portion segments, for allowing the second member to engage with and slide at least partially over the blade portion of the first member.

DESCRIPTION OF THE DRAWINGS

These, and other features and advantages of the present invention will be better understood by reading the following detailed description, taken together with the drawings wherein.

DETAILED DESCRIPTION OF THE INVENTION

Figure 1:
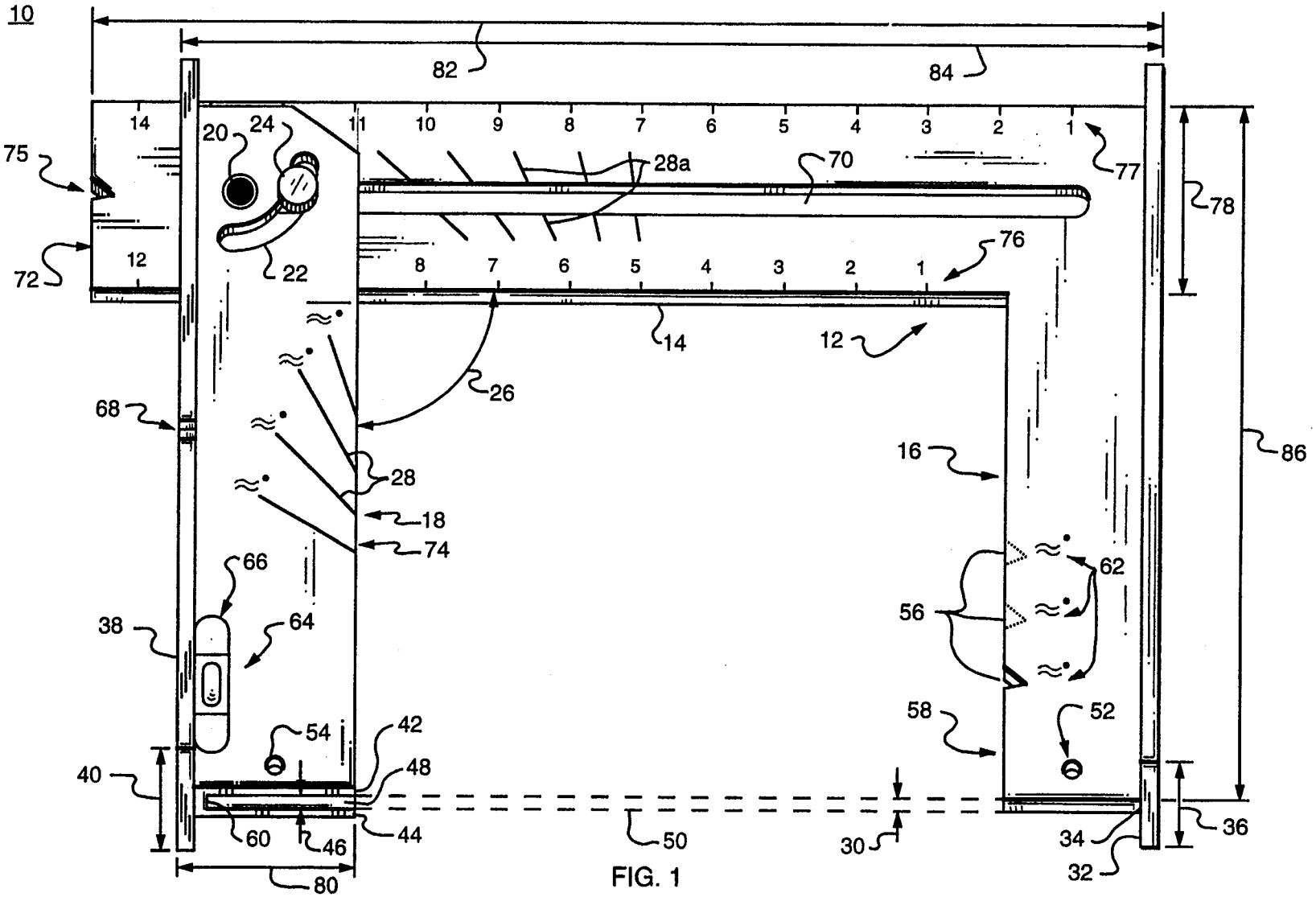
FIG. 1 is a plan view of the combination square and multi-purpose hand tool according to the present invention in the fully extended position.

The combination square and multi-purpose hand tool of the present invention is shown generally at 10, FIG. 1, and includes a first member 12 having a blade portion 14 and a handle portion 16. Also included is a second member 18 which is pivotably coupled to the blade portion 14 of first member 12 by means of pivot pin 20, about which the second member 18 may pivot. The second member 18 is provided with a curvilinear shaped slot 22 in which is disposed a retaining member 24, such as a thumb screw, to facilitate holding the second member in any angular position against the blade portion 14 of first member 12.

Accordingly, the second member 18 is adapted to pivot from a first position (as shown in the drawing) parallel to handle portion 16 of first member 12 inwardly as shown by arrow 26 against blade portion 14 of first member 12. Additionally, angular markings 28, **28*a* on one or both of the surfaces of the blade 14 or the second member 18, allow the user to determine the angular position of the second member 18 with respect to the blade portion 14. Further, one of the markings 28, 28*a*** include pitch angle marks scribed into the member to allow the user to determine pitch angles as in the case of roof pitch angles. Alternatively, angle markings may be provided on one of the members, while pitch markings (for example 1/12 through 12/12) may be provided on the remaining member or on the reverse side of that same member such as the blade or the second member.

Both the first member 12 and second member 18 are preferably made from a durable and rigid material such as aluminum, approximately $\frac{1}{8}$ inch in thickness, such thickness indicated generally by arrows 30. In one embodiment, handle portion 16 of first member 12 includes a butt portion 32 proximate the outside edge 34 of handle portion 16. Butt portion 32 has a width indicated generally by arrows 36 which is substantially greater than the thickness 30 of the remainder of the handle portion 16. In the preferred embodiment, the butt portion 32 has a width of approximately $\frac{3}{4}$ inch. The handle portion 16 is approximately centered in the butt portion 32, thus allowing approximately $\frac{3}{8}$ inch between the handle portion 16 and the outer edge of the butt portion 32.

Similarly, the second member 18 may also includes a butt portion 38 having a width indicated generally by arrow 40 which is substantially greater than the thickness of any individual segment of the second member 18, and also preferably $\frac{3}{4}$ inch.

In the preferred embodiment, the second member 18 includes first and second segments 42, 44 which are held in spaced relationship a predetermined distance indicated generally by arrow 46. The recessed region 48 formed by the space between the first and second segments 42, 44 forms a region having a thickness slightly greater than the thickness 30 of the handle portion 16 of the first member 12, thus allowing the recessed region 48 of second member 18 to engage with the handle portion 16 of first member 12 as shown by dashed lines 50.

In order to facilitate use of the combination square and multi-purpose hand tool of the present invention as will be more fully illustrated below, both the handle portion 16 and the second member 18 include fastening holes 52, 54, respectively, to facilitate attachment of the first and second members to an adjacent device, for allowing the combination square and multi-purpose hand tool of the present invention to function as a "deadman" or timber holder as will also be illustrated below.

An additional feature of the present invention includes one or more angular positioning devices, such as V shaped cutout regions 56 in the inside edge 58 of the handle portion 16 of first member 12. These cutout regions are designed to engage with region 60 in the recess 48 of the second member 18 to facilitate exact placement of the second member in a predetermined angular relationship with the blade as indicated by indicia 62. In this manner, the user may accurately set the second member to act as an angle square at a predetermined angle of, for example, 45 degrees, 30 degrees, or other predetermined angular positions.

The second member 18 of the combination square and multi-purpose hand tool of the present invention further includes a level 64 and at least one level viewing window 66. In the preferred embodiment, both first and second segments 42, 44 of the second member 18 include a level viewing window. In the embodiment, including a butt region, butt region 38 also includes a level viewing window as will be illustrated further below. Additionally, butt portion 38 of the second member 18 includes a notch 68 through which a string may be passed when the multi-purpose hand tool of the present invention is being utilized as a string tender, as will also be further illustrated below.

The blade portion 14 of the first member 12 of the present invention includes an elongated slot or cutout region 70 which extends from proximate the butt portion 32 of handle 16 to proximate the end region 72 of blade portion 14. The elongated slot 70 allows the second member 18 to be moved from a first position engaged with the handle portion 16, to a second position as presently illustrated. The ability to move the second member 18 in and out against the handle portion 16 allows the second member 18 to function as a clamp using inside edge 58 of handle portion 16 and inside edge 74 of the second member 18 as the clamp surfaces. By tightening the adjustable member 24, the second member 18 can be held securely in place. Additionally, the ability to move the second member 18 in and out against the inside edge 58 of the handle portion 16 allows the present invention to be utilized as a caliper, wherein distances may be measured utilizing the inside scale or graduations 76 on blade portion 14 of the first member 12.

A key feature of the present invention are various structural dimension of various members which allows the combination square and multi-purpose hand tool of the present invention to be extremely useful as a multi-purpose hand tool for framing contractors. For example, the width of blade portion 14 which is indicated generally by arrow 78 corresponds to the width of a standard framing timber, presently 1½ inches, which corresponds to the thickness of most framing timber such as 2×4's, 2×6, 2×8's, etc. It is understood that this width is changeable if framing timber widths change. The usefulness of this blade width will be illustrated further below. Similarly, the width of second member 18 indicated generally by arrow 80 also corresponds to the width of a standard framing timber, presently 1½ inches. The usefulness of this dimension, when the present invention is used as a string tender, will be illustrated in FIG. 6 below.

Additionally, the present invention features two additional key dimensions. The first, is the overall length of the first member 12, indicated generally by arrow 82, which is the distance between two standard 1½ inch framing timbers located 16 inches on center, namely 14½ inches. As stated, this dimension was chosen as it corresponds to the space between the traditionally spaced 16 inches on center framing timbers. It is understood, however, that this dimension can be changed to accomodate both a change in width of standard framing lumber, as well as different timber spacing, such as 24 inches on center.

Thus, as will also be illustrated below, the multi-purpose hand tool of the present invention quickly, and without adjustment, is adapted for use as a stud spacer. Additionally, the dimensions of the fully extended second member 18 as indicated generally by arrow 84 corresponds to 13½ inches, which is the space between two 1 inch by 3 inch ceiling strap timbers, commonly referred to as strap furring. This distance may also be modified to accomodate changes in dimension of lumber.

Additionally, a second scale 77 proximate an outside edge of the blade portion 14 of first member 12 may be utilized as a ruler, as well as a scale for reading the inside dimension of an object when the second member and the first member 16 are utilized as calipers.

Although the length of the handle portion 16 and the second member 18 indicated generally by arrow 86 is not considered to be critical, the preferred embodiment contemplates each member having a length of approximately 6 inches. Similarly, the width of the handle portion 16 is approximately 1½ inches although such a width is also not critical.

Figure 2:
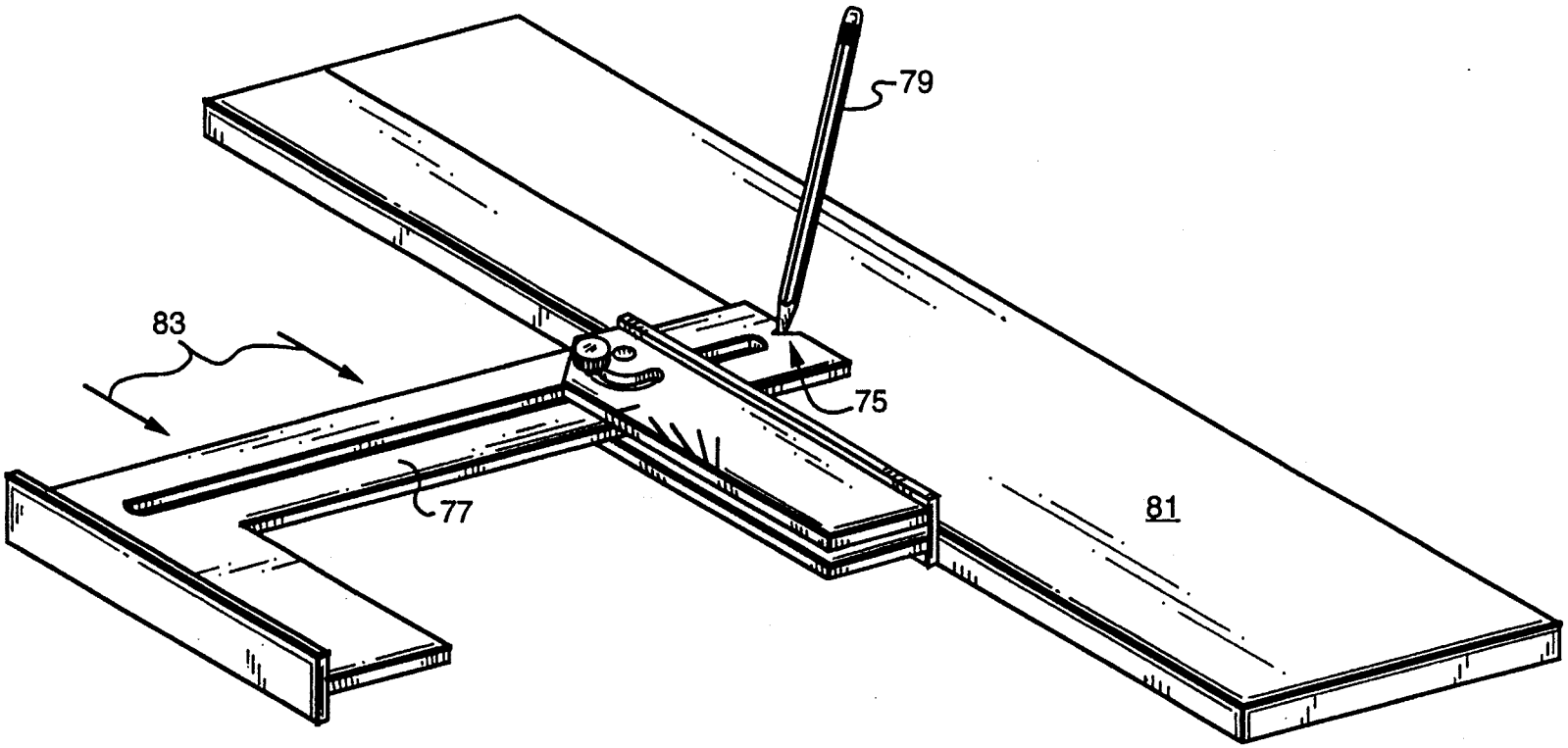
FIG. 2 is a plan view illustrating the combination square and multi-purpose hand tool of the present invention used as a scribe.

Notch 75 allows the combination square and multi-purpose hand tool of the present invention to be used as a scribe 77, FIG. 2, by placing pencil 79 in notch 75 and sliding the second member 18 along board 81 in the direction indicated by arrows 83.

Figure 3:
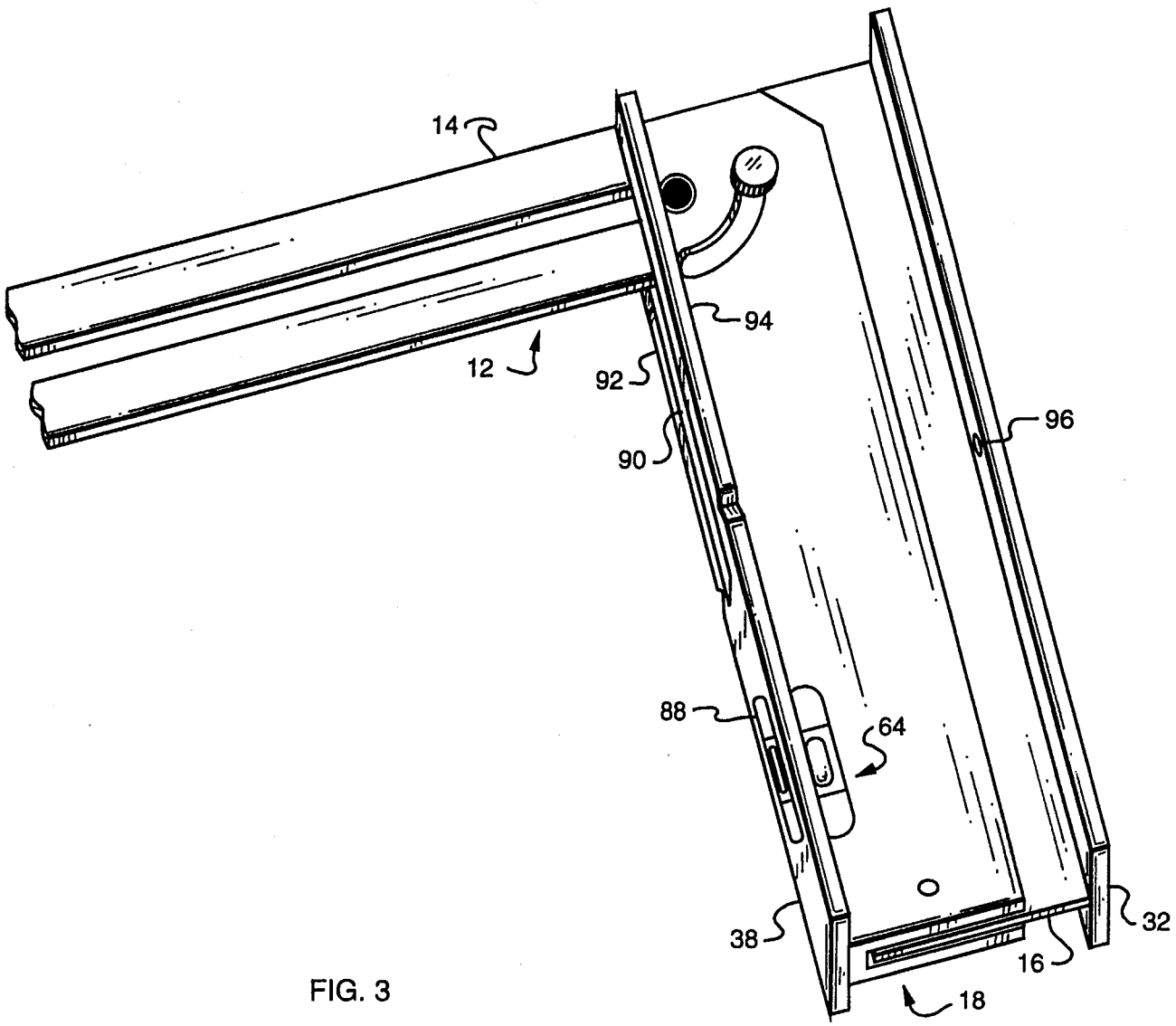
FIG. 3 is a partial plan view of the combination square and multi-purpose hand tool of the present invention in the fully closed position.

The combination square and multi-purpose hand tool according to one embodiment of the present invention is shown in FIG. 3 with the second member 18 fully engaged with the handle portion 16 of the first member 12. This Figure further illustrates a second window or viewing area 88 for level 64 disposed in the butt portion 38 of the second member 18. Additionally, this Figure serves to illustrate the split nature of butt portion 38 proximate blade 14. Providing butt portion 38 with cutout region 90 forming first and second butt portion segments 92 and 94 facilitates the angular displacement of second member 18 for use as a bevel or angle square. Additionally, it is noted that butt portion 32 which forms part of the handle portion 16 of first member 12 also includes one or more fastening holes 96 to facilitate the attachment of at least the handle portion 16 to an adjacent device such as a timber.

Figure 4:
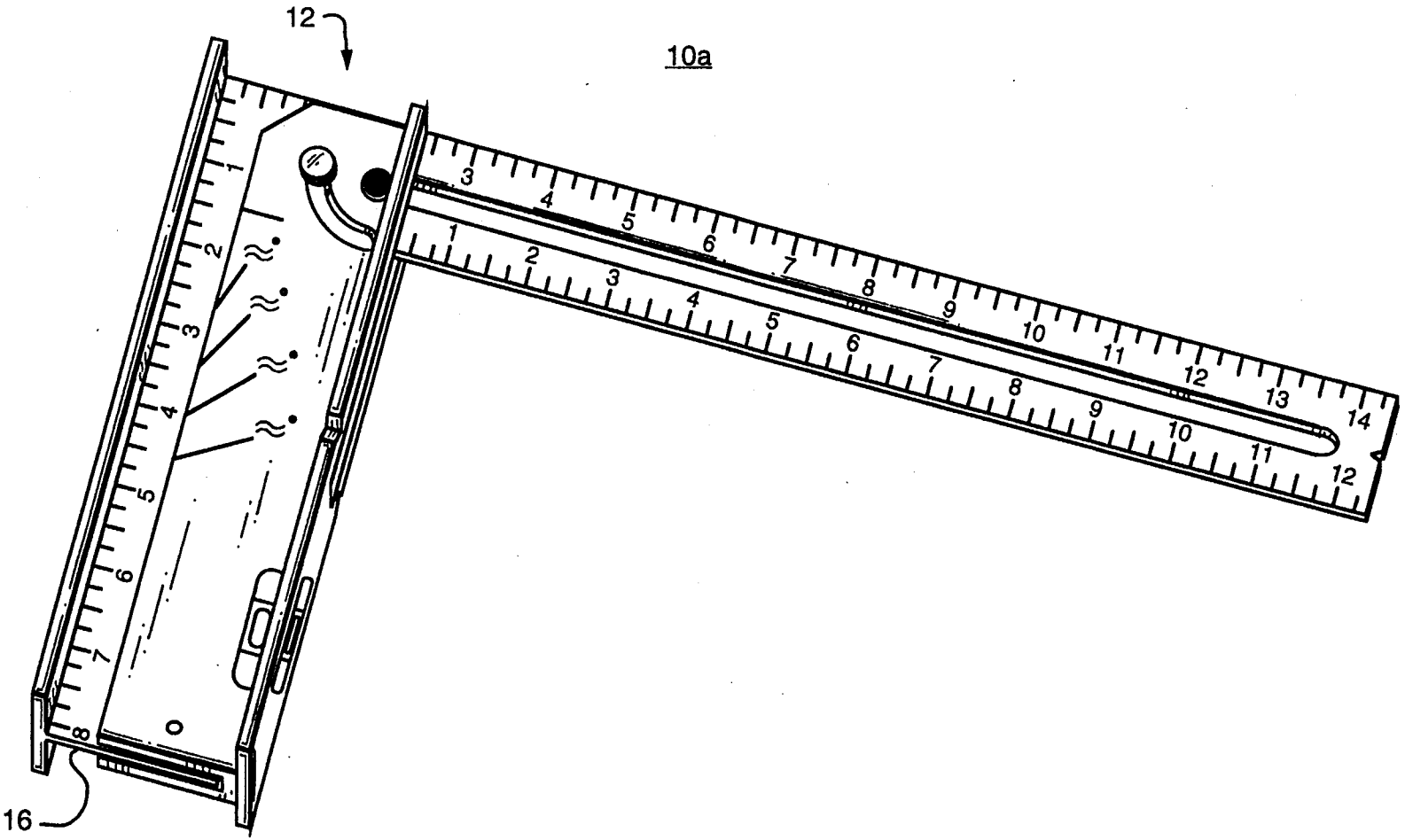
FIG. 4 is a plan view of the preferred embodiment of the combination square and multi-purpose hand tool of the present invention.

In the preferred embodiment, the combination square and multi-purpose hand tool of the present invention 10*a*, FIG. 4, does not include a butt region on the handle portion 16 of the first member 12.

Figure 5:
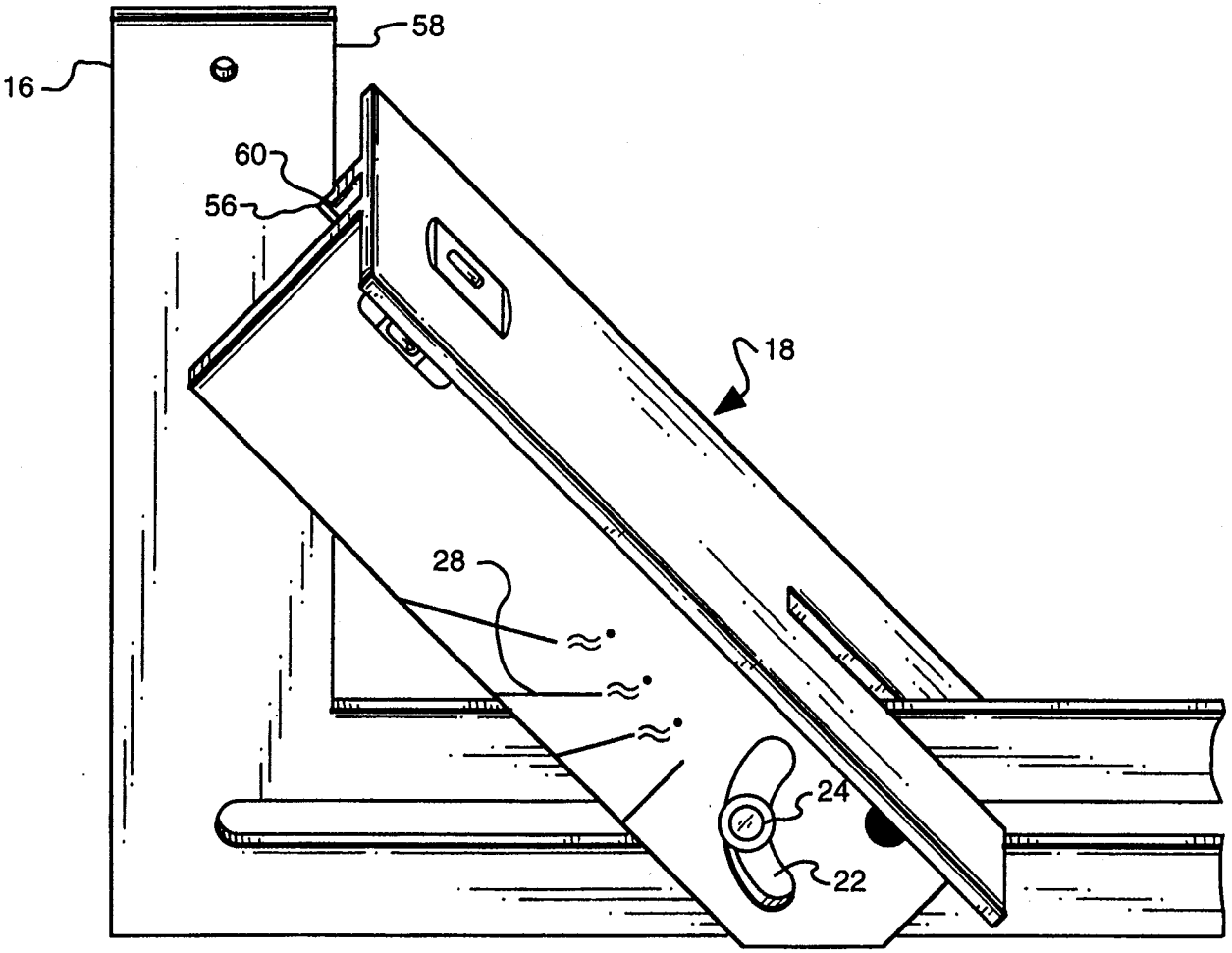
FIG. 5 is a partial schematic representation of the combination square and multi-purpose hand tool of the present invention configured for use as an angle square.

The use of the combination square and multi-purpose hand tool of the present invention as an angle square is illustrated in FIG. 5 wherein is shown portion 60 of second member 18 located in the angular member positioning notch 56 in the inside edge 58 of handle portion 16. For exemplary purposes only, this is illustrated as 45 degrees as indicated by indicia and markings 28 proximate the curvilinear shaped slot 22 in the second member 18.

Various additional and practical uses for the combination square and multi-purpose hand tool of the present invention will now be illustrated in conjunction with FIGS. 6 through 9.

Figure 6:
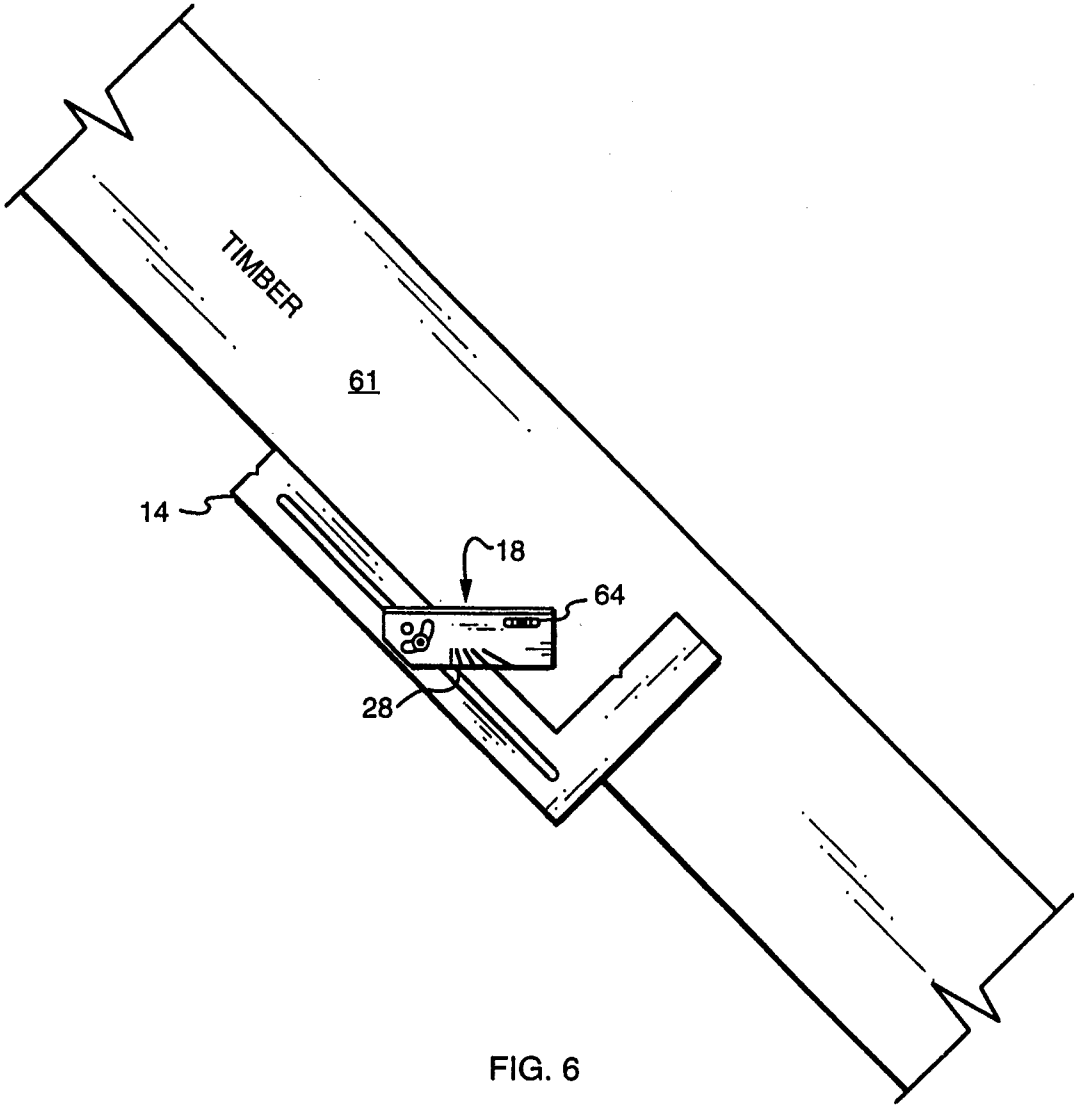
FIG. 6 is a plan view of the combination square and mutli-purpose hand tool of the present invention used as a bevel square or angle finder.

FIG. 6 illustrates the present invention used as a pitch finder wherein blade 14 is placed in contact with angled timber 61 (such as a roof rafter). The second member 18 is pivoted until the level 64 is centered. The pitch angle may then be read from the marks or indicia 28 scribed on the second member 18. Additionally, the second member may be secured in place and used to transcribe the angle onto another timber.

Figure 7:
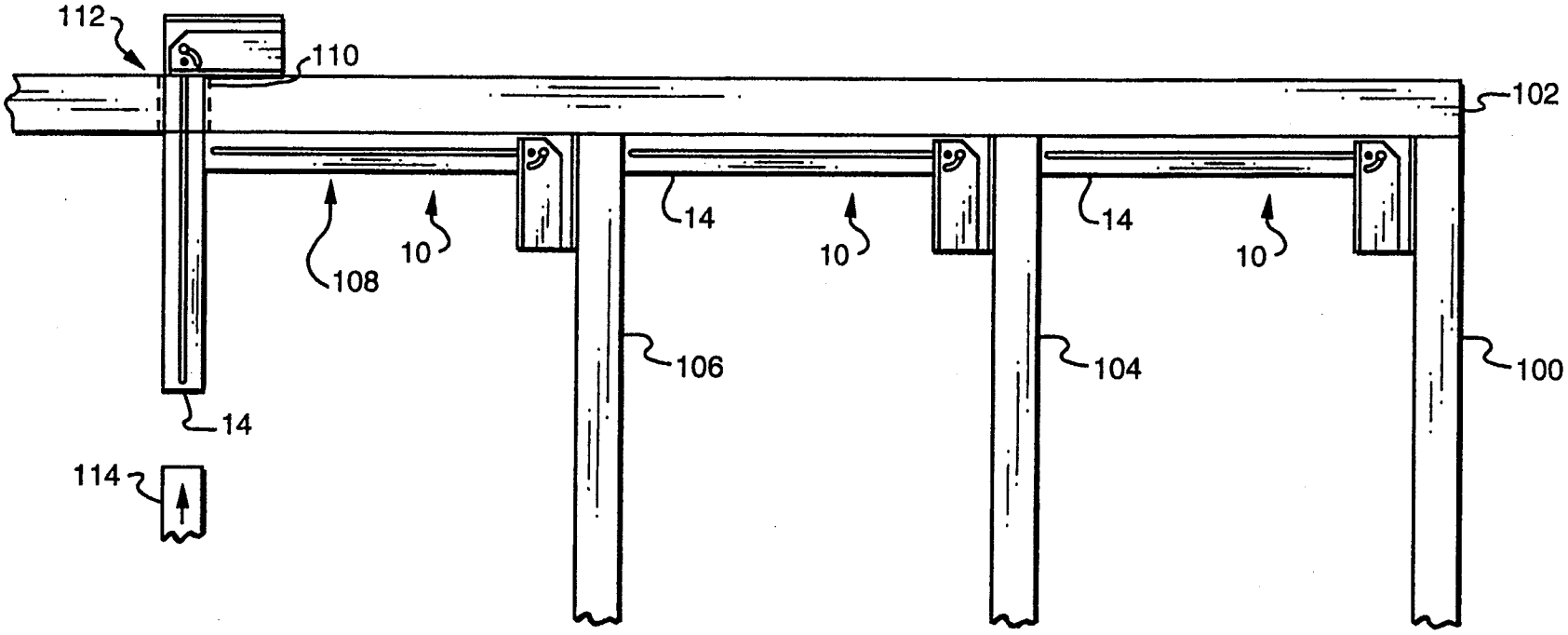
FIG. 7 is an illustration showing the use of the combination square and multi-purpose hand tool of the present invention to layout framing timber.

FIG. 7 illustrates use of the present invention as a stud spacer. After installing a first stud member 100, such as a 2×4 or 2×6, to a perpendicular member 102, commonly referred to as a sill plate or top plate, the combination square and multi-purpose hand tool 10 is placed against the first stud member 100 while the second stud member 104 is placed against the blade 14 and nailed into place. Since the outside dimension of the combination square and multi-purpose hand tool of the present invention is 14½ inches which corresponds to the spacing between two 1½ inch wide timbers spaced 16 inches on center, the second stud 104 is now perfectly positioned 16 inches on center from the first stud member 100.

Subsequently, the combination square and multi-purpose hand tool 10 of the present invention is repositioned against the second stud member 104 following which a third stud member 106 is positioned against the blade 14 and nailed into place.

Alternatively, if it is desired to merely measure for the placement of studs, the combination square and multi-purpose hand tool 10 of the present invention may be placed against an existing stud member or against the end of a plate as shown generally at 108, and a first line drawn or marked as shown at 110. Subsequently, the combination square and multi-purpose hand tool of the present invention may be rotated 90 degrees and the blade portion 14 of exactly 1½ inches, (the current width of framing timber), used to fully mark lines 112,110, which serve as markings to align a subsequent stud 114 to be placed against the sill 102.

Thus, marking the sill or utilizing the combination square and multi-purpose hand tool of the present invention to actually space the studs may continue in a quick, efficient and exact manner along the sill and top plate of a wall or other structure being framed. The dimensions of the present invention ensure that each and every stud will be precisely and accurately spaced with its' adjacent member.

Figure 8A:
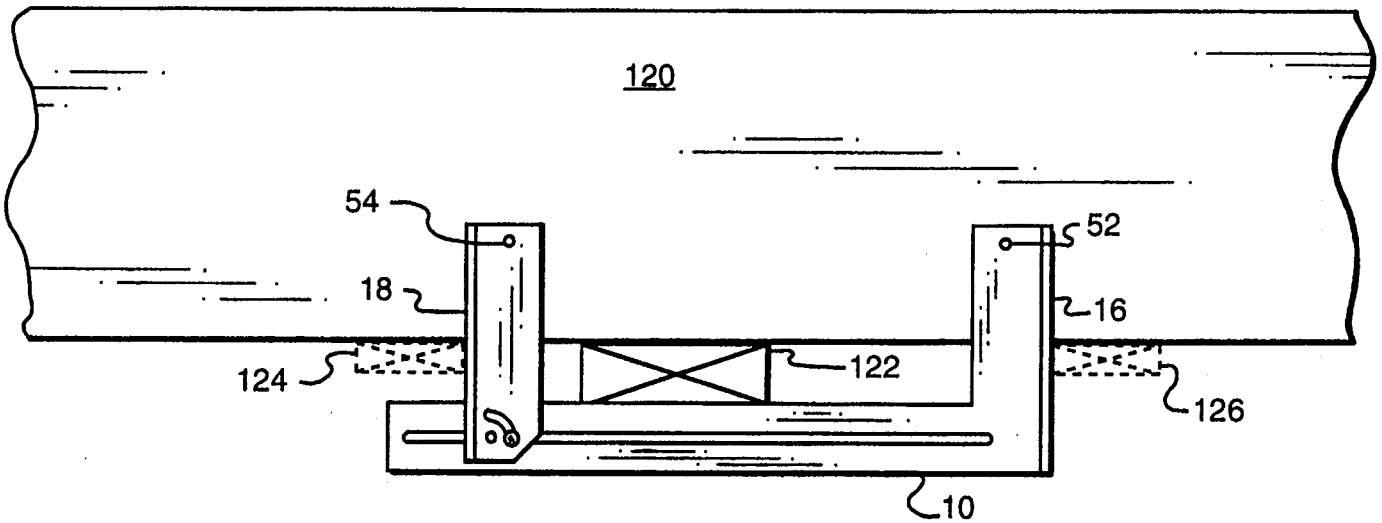
FIG. 8A and 8B illustrate the combination square and multi-purpose hand tool of the present invention being utilized as a "deadman" timber holder and furring strip spacer.
Figure 8B:
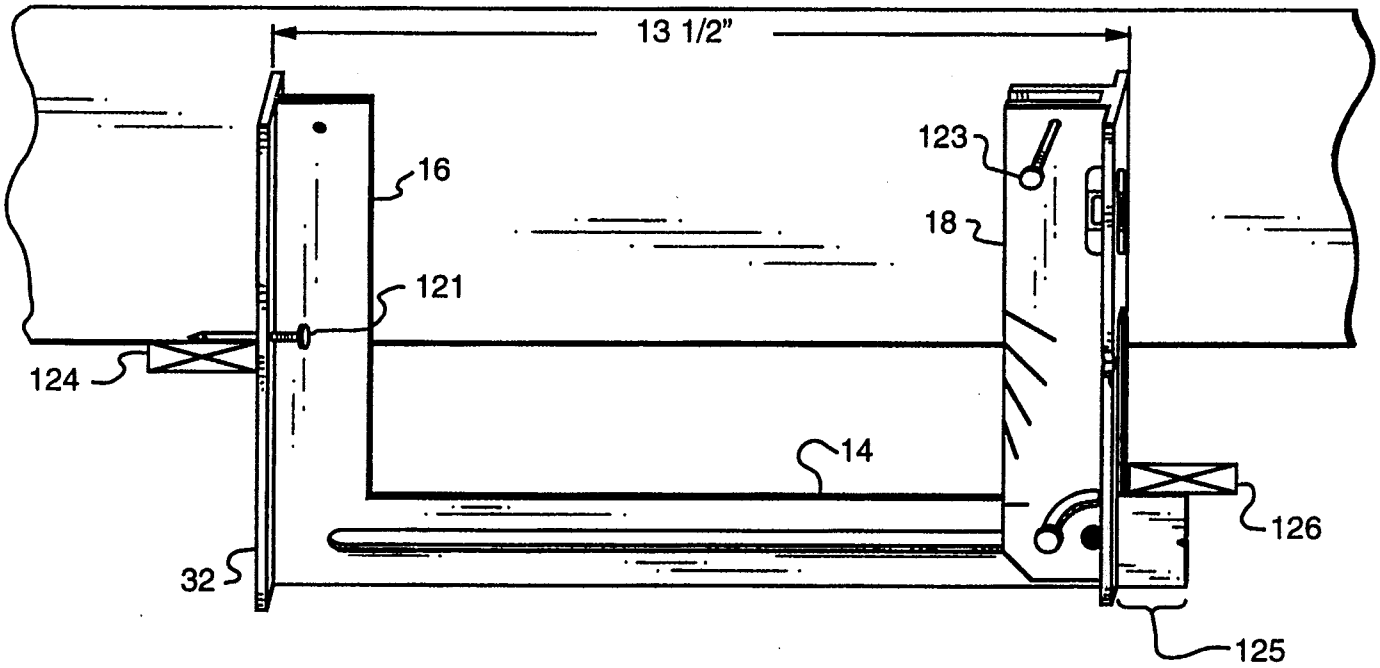

An additional use of the combination square and multi-purpose hand tool of the present invention as a deadman and ceiling strapping spacer is illustrated in FIGS. 8A and 8B wherein the combination square and multi-purpose hand tool 10, FIG. 8A, may be nailed through the handle portion 16 of the first member and the second member 18 through first and second fastening holes 52, 54, into an existing timber 120, such as a floor joist. In this manner, the combination square and multi-purpose hand tool of the present invention can support ceiling strapping member 122 unaided, thus freeing up a single or lone carpenter to measure and begin fastening another end of the strapping 122. Additionally, as shown in this drawing, the combination square and multi-purpose hand tool of the present invention, when in its' fully extended position, can be used to provide the proper spacing between first and second ceiling strapping members 124, 126.

As shown in the embodiment of FIG. 8B, the present invention can be supported proximate handle portion 16 by inserting nail 121 through the butt portion 32, and resting the nail on the first furring strip 124. A second nail 123 is inserted into the floor joist 120 through the second member 18. The portion 125 of blade 14 both supports and accurately spaces the second furring strip 126 until nailed in place.

Figure 9:
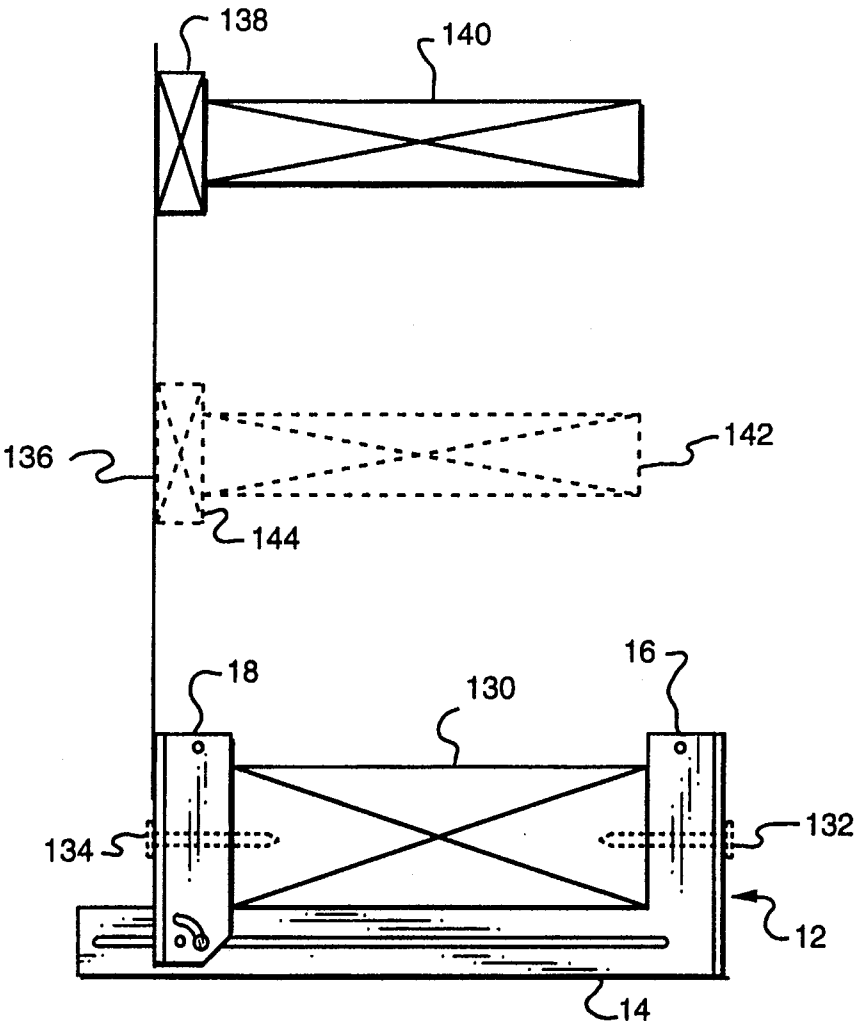
FIG. 9 is an illustration showing the combination square and multi-purpose hand tool of the present invention in use as a clamp and string tender.

The combination square and multi-purpose hand tool of the present invention is further illustrated as a clamp and string tender in FIG. 9. As illustrated, the handle portion 16 of the first member 12 and the second member 18 are used as a clamp to grip the device about an existing stud member 130. One or more nails 132, 134 may be inserted through the butt portions of the handle portion 16 and the second member 18 to further fasten the combination square and multi-purpose hand tool of the present invention to the stud 130.

Subsequently, a string 136 is attached to the second member 18 and stretched along the length of a wall to be leveled. Given that the second member 18 has a width of exactly 1½ inches in the present preferred embodiment, a small piece of standard framing material 138 may be inserted between the string 136 and a second stud 140 forming the end of a wall to be leveled. Subsequently, any intermediary stud member 142 may be leveled by merely inserting a similar spacer member 144 between the string 136 and the stud 142. In this manner, utilizing the combination square and multi-purpose hand tool of the present invention as a string tender also allows a single or lone carpenter to perform this function without the necessity of setting up multiple blocks for use as a string tender.

In summary, the combination square and multi-purpose hand tool of the present invention thus provides a single novel and useful multi-purpose hand tool which functions as a large number of hand tools, very useful to carpenters in particular, framing carpenters.

Modifications and substitutions by one of ordinary skill in the art are considered to be within the scope of the present invention which is not to be limited except by the claims which follow.

I claim:

1. A multi-purpose hand tool comprising:

a first member having a predetermined length corresponding to a space between two framing timbers installed a specified distance apart, said first member including a blade portion and a handle portion, said handle portion including an inside edge and an outside edge extending from and generally perpendicular to said blade portion, said blade portion having a predetermined width;

a second member slidably and pivotably coupled to said blade portion of said first member and having a predetermined width, said second member including an inside edge facing said inside edge of said handle portion and an outside edge;

a butt portion fixed to at least one of said handle portion and said second member on said outside edge of said at least one of said handle portion and said second member, perpendicular to first and second planar surfaces of said at least one of said handle portion and second member, said butt portion having a width which is greater than a predetermined thickness of said at least one of said handle portion and said second member;

means for pivotably coupling said second member to said blade portion of said first member; and means for allowing said second member to slide along said blade portion while coupled to said blade portion of said first member, between a first position proximate said handle portion and a second position proximate an end region of said blade portion, said end region of said blade portion opposite said handle portion of said first member, for providing a multi-purpose hand tool reconfigurable for a plurality of purposes.

2. The multi-purpose hand tool of claim 1, wherein said predetermined length of said first member is 14½ inches.

3. The multi-purpose hand tool of claim 1, wherein said predetermined width of said blade portion and said second member corresponds to a predetermined width of common framing timbers.

4. The multi-purpose hand tool of claim 3, wherein said predetermined width of said blade portion and said second member is 1½ inches.

5. The multi-purpose hand tool of claim 1, wherein said butt portion is fixed to said handle portion and includes at least one fastening hole, for facilitating attachment of at least said handle portion to an adjacent device.

6. The multi-purpose hand tool of claim 1, wherein each of said handle portion and said second member include at least one fastening hole, for facilitating attachment of said multi-purpose hand tool to at least a first, adjacent device, for temporarily holding a second, unfixed adjacent device against said blade portion, for facilitating use of said multi-purpose hand tool as a deadman holder.

7. The multi-purpose hand tool of claim 1, wherein said inside edge of said handle portion includes at least one second member angular positioning device, for engaging with said second member, and for establishing at least one predetermined angular position between said first member and said second member.

8. The multi-purpose hand tool of claim 7, wherein said at least one second member angular positioning device includes a cutout region in said inside edge of said handle portion.

9. The multi-purpose hand tool of claim 8, wherein said second member includes a level.

10. The multi-purpose hand tool of claim 1, wherein said butt portion is fixed to said second member and includes at least one cutout region, for engaging with a string, for allowing said multi-purpose hand tool to serve as a line tender.

11. The multi-purpose hand tool of claim 1, wherein said means for pivotably coupling said second member to said blade portion of said first member includes a pivot pin, pivotably coupling said second member to said blade portion;

a curvilinear shaped cutout region in said second member; and means for releasably securing said second member to said blade portion of said first member, said means for releasably securing disposed in said curvilinear shaped cutout region of said second member, for releasably securing said second member to said blade portion in an angular position relative to said first member, for allowing said multi-purpose hand tool to serve as an adjustable bevel square.

12. The multi-purpose hand tool of claim 11, wherein said second member further includes indicia for visually determining said angular position between said second member and said first member.

13. The multi-purpose hand tool of claim 1, wherein said means for allowing said second member to slide along said blade region includes a cutout region in said blade portion, said cutout region extending from proximate said handle portion to proximate an end region of said blade portion.

14. The multi-purpose hand tool of claim 1, wherein said second member includes first and second segments held in spaced parallel relationship a predetermined distance, said predetermined distance slightly greater than a predetermined thickness of said handle portion of said first member, for forming a recessed region in said second member facing said handle portion of said first member, for allowing said recessed portion of said second member to engage with and over said handle portion of said first member.

15. The multi-purpose hand tool of claim 1, wherein said butt portion is fixed to said second member and includes a cutout region extending from a first end of said butt portion proximate said blade portion of said first member to a point approximately midway along a length of said second member, said cutout region having a width which is slightly greater than the thickness of the blade portion of said first member, for allowing said blade member to enter said cutout region when said second member is held in an angular position relative to said blade portion of said first member, to facilitate use of said multi-purpose hand tool as a bevel square.

16. A multi-purpose hand tool comprising:

a first member having a predetermined length of 14½ inches, and including a blade portion and a handle portion, said handle portion extending from and generally perpendicular to said blade portion, said blade portion having a predetermined width of 1½ inches;

a second member slidably and pivotably coupled to said blade portion of said first member and having a predetermined width, said second member including a curvilinear shaped cutout region;

a pivot pin disposed through said second member and a cutout region of said blade portion of said first member, for pivotably coupling said second member to said blade portion of said first member;

a releasably securable member disposed in said curvilinear shaped cutout region of said second member and extending through said cutout region of said blade portion of said first member, for releasably securing said second member to said blade portion in an adjustable angular position relative to said first member, for allowing said multi-purpose hand tool to serve as an adjustable bevel and angle square; and said cutout region in said blade portion extending from proximate said handle portion to proximate an end region of said blade portion, for allowing said second member to slide along said blade portion while coupled to said blade portion of said first member, between a first position proximate said handle portion and a second position proximate an end region of said blade portion, said end region of said blade portion opposite said handle portion of said first member, for providing a multi-purpose hand tool reconfigurable for a plurality of purposes.

17. A multi-purpose hand tool comprising:

a first member having a predetermined length and including a blade portion and a handle portion, said handle portion including an inside edge and outside edge and extending from and generally perpendicular to said blade portion, said blade portion having a predetermined width;

a second member slidably and pivotably coupled to said blade portion of said first member and having a predetermined width;

means for pivotably coupling said second member to said blade portion of said first member;

means for allowing said second member to slide along said blade portion while coupled to said blade portion of said first member, between a first position proximate said handle portion and a second position proximate an end region of said blade portion, said end region of said blade portion opposite said handle portion of said first member, for providing a multi-purpose hand tool reconfigurable for a plurality of purposes; and at least one second member angular positioning device disposed on said inside edge of said handle portion, for engaging with said second member, and for establishing at least one predetermined angular position between said first member and said second member.

* * * * *